United States Patent [19]

Ducasse

[11] 4,403,743

[45] Sep. 13, 1983

[54] ARTICULATED KNIFE ROTOR ASSEMBLY IN A MACHINE FOR REDUCING MATERIALS

[75] Inventor: Joseph C. V. Ducasse, Martinez, Calif.

[73] Assignee: Fabcon Incorporated, San Francisco, Calif.

[21] Appl. No.: 270,124

[22] Filed: Jun. 3, 1981

[51] Int. Cl.[3] ..... B02C 13/26

[52] U.S. Cl. ..... 241/194; 241/282.2; 241/292.1

[58] Field of Search ..... 241/189 R, 189 A, 195, 241/194, 294, 282.2, 292.1

[56] References Cited

U.S. PATENT DOCUMENTS

| | | | |
|---|---|---|---|
| 904,908 | 11/1908 | Williams | 241/194 |
| 1,821,912 | 9/1931 | Pfeiffer | 241/194 X |
| 1,909,623 | 5/1933 | McDowell | 241/194 |
| 3,532,145 | 10/1970 | Ducasse . | |
| 3,857,520 | 12/1974 | Ducasse . | |

FOREIGN PATENT DOCUMENTS

| | | | |
|---|---|---|---|
| 7705618 | 11/1978 | Netherlands | 241/194 |

*Primary Examiner*—Mark Rosenbaum

*Attorney, Agent, or Firm*—Wenderoth, Lind & Ponack

[57] ABSTRACT

An articulated knife rotor assembly in a machine for reducing materials includes a shaft rotated about the longitudinal axis thereof. A plurality of blade holders are rigidly fixed to the shaft for rotation therewith. Each blade holder extends from the shaft generally radially with respect to the axis of the shaft. Each blade holder has mounted therein for relative rotation with respect thereto about an axis of rotation at least one block member. Each block member has fixed thereto at least one knife blade. Rotation of the shaft causes rotation of the blade holders, the block members and the knife blades. However, each knife blade is pivotable with respect to the respective blade holder about the axis of rotation of the respective block member.

20 Claims, 4 Drawing Figures

ARTICULATED KNIFE ROTOR ASSEMBLY IN A MACHINE FOR REDUCING MATERIALS

BACKGROUND OF THE INVENTION

The present invention is directed to an improved articulated knife rotor assembly for use in a machine for reducing materials, and to a machine including such assembly. The present invention is particularly directed to such improved assembly in a machine for reducing by cutting action various materials, such as sugar cane, paper, trash, etc.

It is known to grind up or reduce in size various material by means of an assembly including a rotor having therearound a plurality of knives. In such known arrangements, the rotors are constructed according to the same general design which includes a shaft on the periphery of which are mounted, either pivotally or rigidly, a plurality of cutting blades, the tips of which rotate past the surface or deck of a conveyer which feeds the material to be reduced. The construction of a conventional pivotally mounted knife rotor assembly has invariably included a number of discs disposed axially on a shaft and inter-connected near their peripheries by means of a plurality of longitudinal pivot bars onto which are mounted rows of knife blades which lie between the discs.

This type of conventional arrangement does however suffer from certain inherent disadvantages. Thus, there is no way to replace a single blade without having to pull out the entire rod on which the blade to be replaced is supported. This operation becomes even more difficult when the blade in question happens to be located other than at the end of the roll, since all of the blades preceding the blade to be replaced have to be removed before replacement can be made. The type of rod involved can only be pulled out sideways, and thus special and expensive arrangements must be made to make room for the rod to be pulled entirely outwardly so as to not interfere with exterior equipment of the machine, such as the drive assembly, fly wheel, etc.

Additionally, the size of the rods involved is usually limited to be approximately 1.5" in diameter. This size is too small of a bearing area for the blades, and therefore the rods and the portions of the blades which rotate about the rods are subjected to a high rate of wear during operation of the machine.

Due to the above disadvantages, the conventional pivotally mounted knife blade rotor assembly has not found wide acceptance in various industries around the world.

The type of knife rotor assembly used in the sugar cane industry throughout substantially the entire world is a conventional rigidly mounted knife blade rotor assembly. However, the use of such assemblies having rigidly mounted knife blades has gradually become more of a problem, since the sugar cane industry is shifting from hand to mechanical harvesting and/or loading of sugar cane due to the amount of foreign material, such as rocks and tramp iron which find their way along with the sugar cane to the cane processing factories. Upon encountering such hard foreign materials, rigidly mounted knife blades are almost invariably broken, and the resultant broken blade pieces often find their way to the the mills in the sugar cane factories, thereby causing considerable damage to the mill rollers and impairing the juice extraction production efficiency of the entire milling plant. The frequently broken rigidly mounted blades have to be replaced, and this results in a loss of extraction through the loss of sugar in bagasse following a work stoppage.

SUMMARY OF THE INVENTION

With the above discussion in mind, it is an object of the present invention to provide an improved articulated knife rotor assembly and a machine employing such assembly which enable the efficient reduction of various materials, such as sugar cane, paper, trash, etc.

A further object of the present invention is to provide such an assembly and machine employing pivoted or articulated knife blades which can be readily and easily replaced.

It is a further object of the present invention to provide such an assembly and machine whereby the pivotally mounted knife blades pivot about a relatively large bearing area, to thereby reduce wear at the points of blade pivoting.

It is a still further object of the present invention to provide such an assembly and machine which operate in a manner similar to shock absorbers by having the ability to retract upon encountering any hard piece of foreign material during operation, thereby considerably reducing the wear on the overall machine and the risk of breakage of the cutting knife blades.

These objects are achieved in accordance with the present invention by the provision of an improved articulated knife rotor assembly and a machine including such assembly. The improved assembly according to the present invention includes a shaft rotated about the longitudinal axis thereof. A plurality of blade holders are rigidly fixed to the shaft to rotate therewith, each blade holder extending from the shaft generally radially with respect to the axis of the shaft. Each blade holder has mounted therein for relative rotation with respect to the blade holder about an axis of rotation at least one block member. Each block member has fixed thereto at least one knife blade. Rotation of the shaft causes rotation of the blade holders, the block members and the knife blades. Each knife blade is pivotable with respect to the respective blade holder about the axis of rotation of the respective block member, such that upon encountering hard foreign material, the knife blades pivot and thereby avoid being broken. The knife blades, during operation, act in a manner similar to shock absorbers while oscillating continually with the ability to retract upon encountering any piece of hard foreign material. This considerably reduces the wear on the overall machine, and thereby reduces the risk of breakage of the knife blades. The reduced wear on the overall machine is additionally attributable to the fact that the pivoting knife blades partially absorb the impacts to which they are constantly subjected during operation, thereby reducing the forces which would otherwise be transmitted through the material to be reduced to the conveying or feeding device. This reduces the wear to which the conveying device is subjected.

BRIEF DESCRIPTION OF THE DRAWINGS

Other objects, features and advantages of the present invention will be apparent from the following detailed description, taken with reference to the accompanying drawings, wherein.

DETAILED DESCRIPTION OF THE INVENTION

Figure 1:
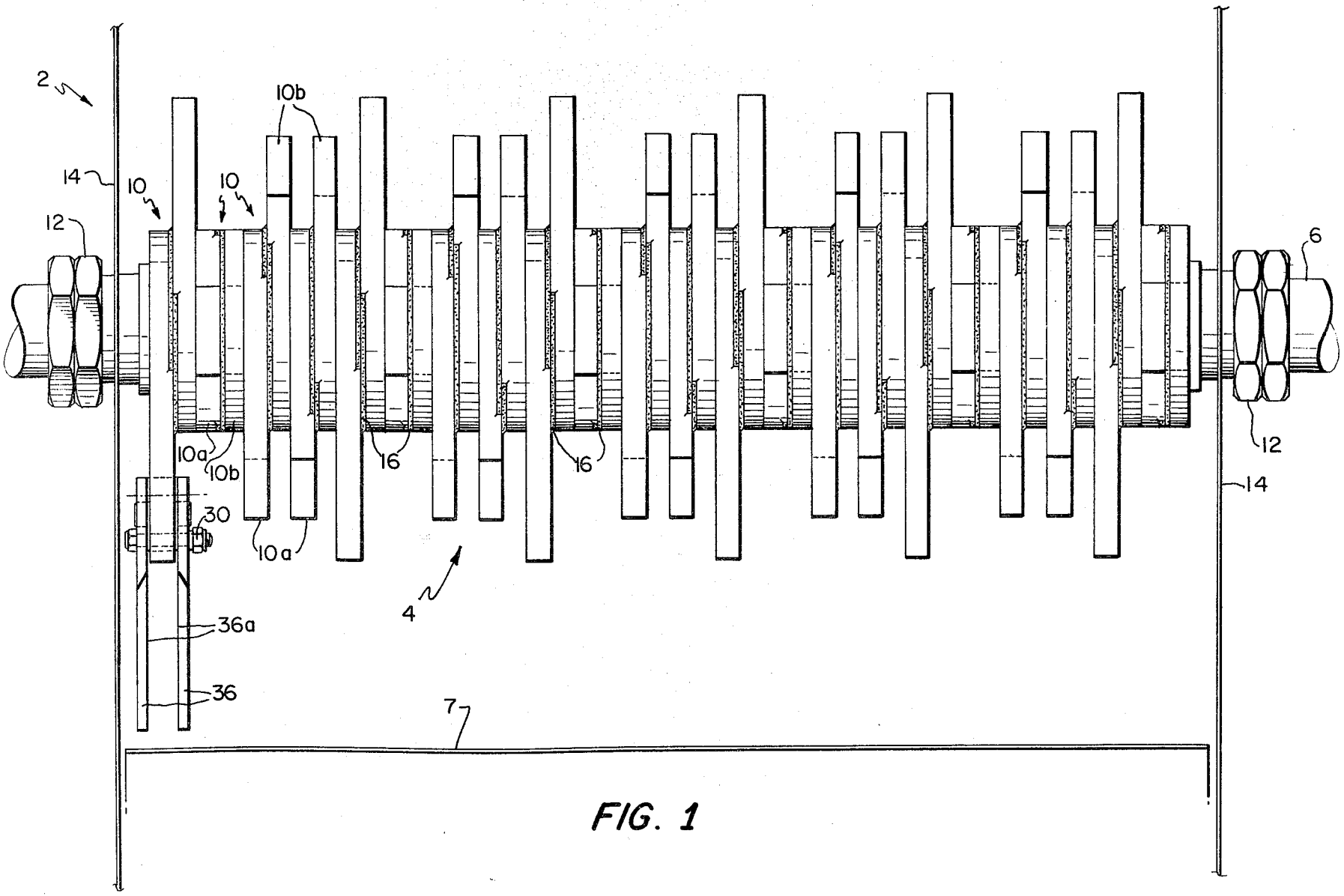
FIG. 1 is an elevation view showing a portion of a machine including the improved articulated knife rotor assembly of the present invention.
Figure 2:
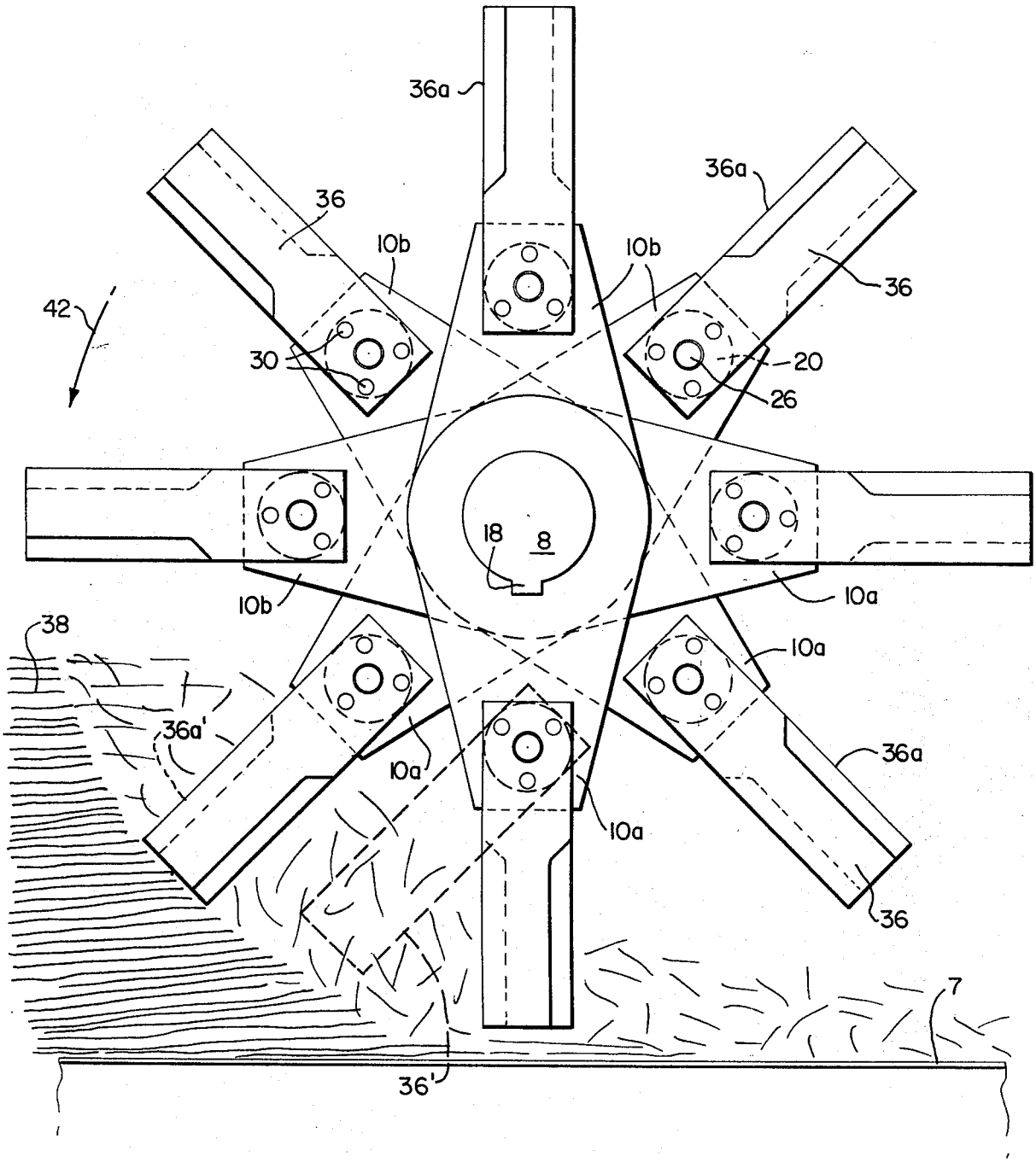
FIG. 2 is an end elevation view from the left side of FIG. 1.
Figure 3:
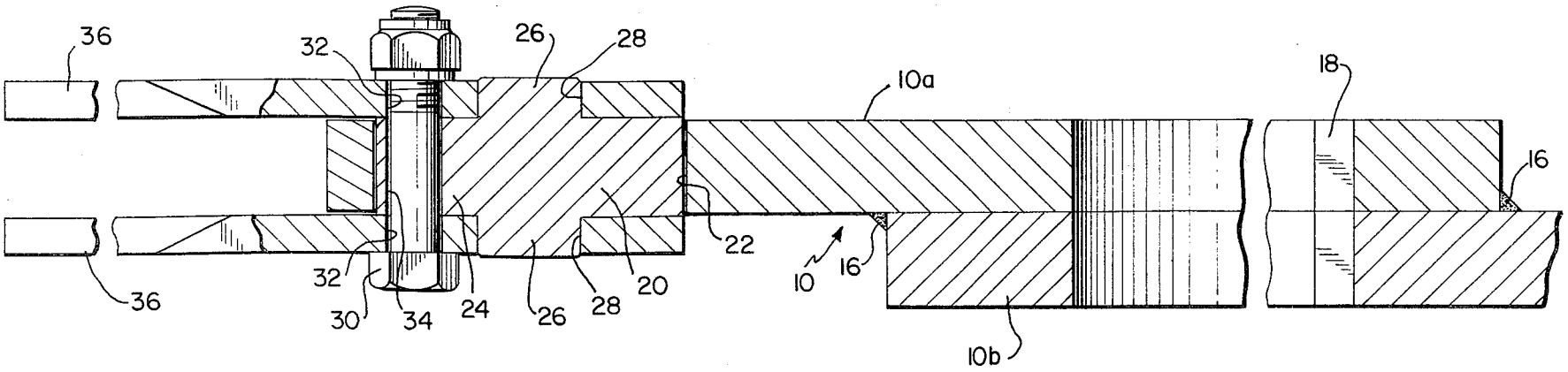
FIG. 3 is an enlarged view, partially in section, illustrating the manner of pivotal mounting of the knife blades.

With reference now to FIGS. 1–3 of the drawings, a preferred embodiment of the present invention will be described. The description will be made with reference to the reducing or cutting of sugar cane, since such is a particularly contemplated advantageous use of the present invention. However, it is to be understood that the present invention is not intended to be limited to use on sugar cane, but rather may be used for reducing or grinding by cutting other types of plant material, particularly stalk-type materials, as well as to other materials, such as trash, paper, etc.

A material reducing machine is generally indicated at 2 in FIG. 1 and includes the novel articulated knife rotor assembly, generally indicated at 4, of the present invention, structure for rotating assembly 4, indicated generally in FIG. 1 as a drive shaft 6, which will be driven in a manner understood by those in the art, and a device 7 for feeding material to be reduced by the assembly 4. FIG. 2 schematically illustrates sugar cane 38 being fed by conveying device 7 to the rotor assembly 4 to be reduced by cutting.

The articulated knife rotor assembly 4 includes a shaft 8 (FIG. 2) mounted for rotation by drive means 6 to extend across the feed conveyer 7 in a direction substantially transverse to the direction of feed thereof. The assembly further includes a plurality of blade holders 10 rigidly fixed to shaft 8 for rotation therewith. The blade holders 10 may be connected to shaft 8 by conventional mechanical expedients such as by means of a key, generally indicated at 18 in FIGS. 2 and 3. Each blade holder 10 extends from shaft 8 generally radially with respect to the longitudinal axis of shaft 8.

In the preferred arrangement of the present invention, each blade holder 10 includes a pair of fixedly connected holder members 10*a*, 10*b* positioned adjacent each other axially of shaft 8. In the illustrated arrangement, the holder members 10*a*, 10*b* of each blade holder 10 are connected by means such as welds 16. The holder members of each blade holder have end portions which extend from the shaft 8 in opposite radial directions. As will be particularly apparent from FIGS. 1 and 2, the holder members of the plurality of blade holders 10 are aligned in plural rows extending axially of shaft 8. Thus, FIG. 2 shows eight axially extending rows of holder members 10*a*, 10*b*. It of course will be understood that the present invention is not intended to be limited to include only eight such rows.

The various blade holders 10 are pressed together as a unit along the length of shaft 8 between side walls 14 of the feed device 7, for example by means of lock nuts 12 as illustrated.

Each blade holder 10, and specifically the outer end portion of each holder member 10*a*, 10*b* thereof, has mounted therein for relative rotation with respect thereto about an axis of rotation at least one block member 20. Each block member 20 has fixed thereto at least one knife blade 36, such that rotation of shaft 8 causes rotation of blade holders 10, block members 20 and knife blades 36. However, each knife blade 36 is pivotable with respect to the respective blade holder 10 about the axis of rotation of the respective block member 20. For purposes of clarity of illustration, only one block member and associated knife blades 36 are illustrated in FIG. 1. It of course will be understood, that the actual apparatus of FIG. 1 would include a block member 20 and associated blades 36 at the outer end of each holder member 10*a*, 10*b*.

The axes of rotation of all of the block members 20 extend parallel to the longitudinal axis of shaft 8. As particularly illustrated in FIG. 3, each block member 20 includes a cylindrical journal portion 24 positioned within a journal opening 22 in the respective holder member 10*a*, 10*b*. In the embodiment of FIG. 3, each block member 20 further includes a pair of oppositely extending guide pin portions 26 which are cylindrical and concentric with respect to journal portion 24. Guide pin portions 26 extend into respective openings 28 in blades 36. Connecting devices, for example the nut and bolt assembly 30 as illustrated in FIG. 3, extend through holes 32 in knife blades 36 and hole 34 in the journal portion of the block member 20. FIG. 2 illustrates that three such bolt assemblies 30 are provided for each block member and associated blades. However, it is intended that the scope of the present invention encompass the use of a number other than three of the bolt assemblies 30. Further, for purposes of clarity of illustration, only one bolt assembly 30 is shown in FIGS. 1 and 3.

The leading edges, with respect to the direction of rotation, indicated by arrow 42 in FIG. 2, of the rotor assembly are provided with cutting edges 36*a*. FIG. 3 particularly illustrates that the cutting edges 36*a* of the two blades associated with each block member are provided on adjacent blade surfaces. As illustrated at 36*a*′ in FIG. 2, the cutting blades may also be provided with cutting edges at the trailing blade edge, such that the knife blade may be reversibly mounted.

Figure 4:
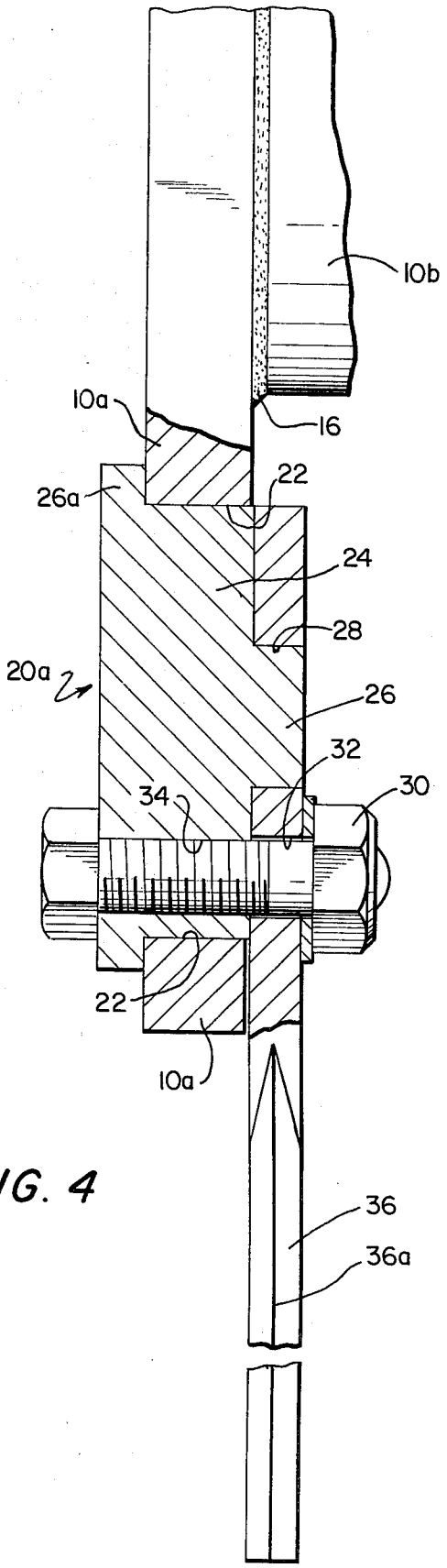
FIG. 4 is a view similar to FIG. 3 but of a modified embodiment of the present invention.

With reference now to FIG. 4 of the drawings, a modified embodiment of the blade and block member construction according to the present invention will be described. Thus, the structure of FIG. 4 is similar to that of FIGS. 1–3, with the exception of the configuration of the block member 20*a*, and with the further exception that only a single knife blade 36 is provided with each block member 20*a*. Thus, block member 20*a* has extending from only a single side thereof a guide pin portion 26. Extending outwardly from the opposite side of journal portion 24 of block member 20*a* is a flange 26*a* which abuts against the adjacent edge of the respective holder member 10*a*, 10*b*. The single blade 36, in the illustrated arrangement having a centrally located cutting edge 36*a*, is supported on guide pin portion 26 and abuts against journal portion 24 adjacent the side of holder member 10*a* opposite to flange 26*a*. It will be apparent that in all other respects, the embodiment of FIG. 4 is similar to the embodiment of FIGS. 1–3.

It will be apparent that in the embodiment of FIG. 3, lateral movement of block member 20 is prevented by blades 36, while in the embodiment of FIG. 4, lateral movement of block member 20*a* is prevented in one direction by blade 36 and in the opposite direction by flange 26*a*. It further will be understood that the respective blades 36 snuggly fit over the respective guide pin portions 26 without any substantial play therebetween. An important feature of the present invention is that the size of the journal portion 24 of block members 20, 20*a* provides a relatively large bearing surface or area. In a typical operational arrangement, the diameter of journal portion 24 would be approximately 6". This large bearing area or surface reduces the wear between journal area 24 and opening 22 during operation of the machine, thereby leading to longer life of the various components than is the case in prior art arrangements.

During operation, the rotor assembly is rotated in the direction of arrow 42, such that sugar cane stalks or sticks 38 are continually cut while being fed by conveyer device 7. During this cutting process, the blades 36 continually oscillate, for example as shown by the dashed position 36' in FIG. 2. Although such oscillations of blades 36 are imperceptible during normal operations, their mere existence is proof that a part of the impacts of the blades 36 cutting into the material 38 are absorbed. Thus, the blades act in a manner similar to shock absorbers. The result is that the conveyer device 7 suffers less wear because it is subjected to fewer impacts through the material 38.

It of course will be understood that should any hard solid objects be fed along with the sugar cane 38, the blades 36, upon contacting such hard objects will pivot, along with their respective block members 20, to the retracted position shown at 36' in FIG. 2, thereby preventing breakage of the blades.

Although the present invention has been described and illustrated with respect to preferred embodiments thereof, it is to be understood that various modifications may be made to such specifically described and illustrated features without departing from the scope of the present invention.

What is claimed is:

1. An articulated knife rotor assembly for use in a machine for reducing materials, said assembly comprising:

a shaft adapted to be rotated about the longitudinal axis thereof;

a plurality of blade holders arranged in axial alignment on said shaft, each said blade holder being fixed on said shaft and prevented from axial, radial and rotary movement with respect thereto, each said blade holder including end portions extending in opposite radial directions from said shaft, each said blade holder end portion having therethrough a journal opening having an axis extending parallel to said shaft axis;

a plurality of block members each including a cylindrical journal portion and at least one reduced diameter guide pin portion extending coaxially from a respective end of said journal portion, said journal portion of each said block member being positioned within and in journal contact with an inner surface of said journal opening of a respective said blade holder end portion, such each said block member is relatively rotatable with respect to said blade holder about said axis of said journal opening;

each said guide pin portion having positioned thereon a respective knife blade; and means for attaching each said knife blade to the respective said block member, such that said knife blade is rotatable with said block member about the respective said journal opening axis, but is prevented from rotation relative to said block member.

2. An assembly as claimed in claim 1, wherein each said blade holder comprises a pair of fixedly connected holder members positioned adjacent each other axially of said shaft, said holder members of each said blade holder defining said end portions extending from said shaft in opposite radial directions.

3. An assembly as claimed in claim 1, wherein each said block member has extending from one end of said journal portion thereof a said guide pin portion and extending from the opposite end of said journal portion thereof a flange.

4. An assembly as claimed in claim 3, wherein said flange abuts an adjacent side of the respective said blade holder end portion, and said knife blade is supported on said guide pin portion adjacent the opposite side of said blade holder end portion, and wherein said attaching means comprises at least one bolt extending through said knife blade and said block member.

5. An assembly as claimed in claim 4, wherein said bolt means extends through said knife blade, said flange and said journal portion at a position outwardly of said guide pin portion.

6. An assembly as claimed in claim 1, wherein each said block member has extending from each opposite end of said journal portion thereof a said guide pin portion, a said knife blade is supported on each said guide pin portion adjacent a respective side of said blade holder end portion, and said attaching means comprises at least one bolt means extending through said knife blades and said block member.

7. An assembly as claimed in claim 6, wherein said bolt means extends through said knife blades and said journal portion at a position outwardly of said guide pin portions.

8. An assembly as claimed in claim 1, wherein each said knife blade has on the leading edge thereof, with respect to the direction of rotation of said shaft, a cutting edge.

9. An assembly as claimed in claim 8, wherein each said knife blade also has on the trailing edge thereof a cutting edge, such that said knife blade may be reversibly mounted.

10. An assembly as claimed in claim 1, wherein said knife blades are aligned in plural rows extending axially of said shaft.

11. In a machine for reducing materials, said machine being of the type comprising an articulated knife rotor assembly, means for feeding material to be reduced to said assembly, and means for rotating said assembly to thereby reduce said material by means of the action of knife blades thereof, the improvement wherein said assembly comprises:

a shaft mounted for rotation about a longitudinal axis thereof by said rotation means to extend across said feeding means in a direction substantially transverse to the direction of feed thereof;

a plurality of blade holders arranged in axial alignment on said shaft, each said blade holder being fixed on said shaft and prevented from axial, radial and rotary movement with respect thereto, each said blade holder including end portions extending in opposite radial directions from said shaft, each said blade holder end portion having therethrough a journal opening having an axis extending parallel to said shaft axis;

a plurality of block members each including a cylindrical journal portion and at least one reduced diameter guide pin portion extending coaxially from a respective end of said journal portion, said journal portion of each said block member being positioned within and in journal contact with an inner surface of said journal opening of a respective said blade holder end portion, such each said block member is relatively rotatable with respect to said blade holder about said axis of said journal opening;

each said guide pin portion having positioned thereon a respective knife blade; and means for attaching each said knife blade to the respective said block member, such that said knife blade is rotatable with said block member about the respective said journal opening axis, but is prevented from rotation relative to said block member.

12. The improvement as claimed in claim 11, wherein each said blade holder comprises a pair of fixedly connected holder members positioned adjacent each other axially of said shaft, said holder members of each said blade holder defining said end portions extending from said shaft in opposite radial directions.

13. The improvement claimed in claim 11, wherein each said block member has extending from one end of said journal portion thereof a said guide pin portion and extending from the opposite end of said journal portion thereof a flange.

14. The improvement claimed in claim 13, wherein said flange abuts an adjacent side of the respective said blade holder end portion, and said knife blade is supported on said guide pin portion adjacent the opposite side of said blade holder end portion, and wherein said attaching means comprises at least one bolt means extending through said knife blade and said block member.

15. The improvement claimed in claim 14, wherein said bolt means extends through said knife blade, said flange and said journal portion at a position outwardly of said guide pin portion.

16. The improvement claimed in claim 11, wherein each said block member has extending from each opposite end of said journal portion thereof a said guide pin portion, and a said knife blade is supported on each said guide pin portion at a respective side of said blade holder end portion, and said attaching means comprises at least one bolt means extending through said knife blades and said block member.

17. The improvement claimed in claim 16, wherein said bolt means extends through said knife blades and said journal portion at a position outwardly of said guide pin portions.

18. The improvement claimed in claim 11, wherein each said knife blade has on the leading edge thereof, with respect to the direction of rotation of said shaft, a cutting edge.

19. The improvement claimed in claim 18, wherein each said knife blade also has on the trailing edge thereof a cutting edge, such that said knife blade may be reversibly mounted.

20. The improvement claimed in claim 11, wherein said knife blades are aligned in plural rows extending axially of said shaft.

* * * * *